United States Patent [19]

Yanagida et al.

[11] Patent Number: 4,874,062

[45] Date of Patent: Oct. 17, 1989

[54] MUFFLER

[75] Inventors: Kouichi Yanagida, Toyota; Shinichiro Kano, Kariya; Takeshi Gotou; Takashi Hirose, both of Aichi, all of Japan

[73] Assignee: Kojima Press Industry Co., Ltd., Aichi, Japan

[21] Appl. No.: 240,935

[22] Filed: Sep. 6, 1988

[30] Foreign Application Priority Data

Sep. 7, 1987 [JP] Japan ..... 62-136589[U]

[51] Int. Cl.[4] ..... F01N 1/02

[52] U.S. Cl. ..... 181/250; 181/272; 181/276

[58] Field of Search ..... 181/250, 266, 272, 273, 181/276, 229, 230

[56] References Cited

U.S. PATENT DOCUMENTS

| | | | |
|---|---|---|---|
| 4,213,414 | 7/1980 | Sato et al. | 181/282 X |
| 4,244,442 | 1/1981 | Scarton et al. | 181/230 |
| 4,415,059 | 11/1983 | Hayashi | 181/250 |
| 4,416,350 | 11/1983 | Hayashi | 181/272 |
| 4,589,516 | 5/1986 | Inoue et al. | 181/282 X |
| 4,700,806 | 10/1987 | Harwood | 181/282 |

FOREIGN PATENT DOCUMENTS

| | | |
|---|---|---|
| 58-114871 | 8/1983 | Japan . |
| 61-123864 | 8/1986 | Japan . |

*Primary Examiner*—B. R. Fuller

*Attorney, Agent, or Firm*—McAulay Fisher Nissen & Goldberg

[57] ABSTRACT

A muffler comprising a casing, a defining member for defining at least two resonance chambers in the casing, and a pipe for flowing a gas therethrough. Each of the resonance chambers has a different resonance frequency, and the pipe is communicated with each resonance chamber. Therefore, a plurality of noise frequencies can be suppressed.

20 Claims, 7 Drawing Sheets

MUFFLER

BACKGROUND OF THE INVENTION

1. Field of the Invention

The present invention relates to a muffler having resonance chambers, more particularly, it relates to a muffler able to suppress a plurality of frequencies.

2. Description of the Related Art

Mufflers are widely utilized in many fields; in particular, a muffler having a resonance chamber for reducing noise produced in the intake and exhaust systems of a combustion engine is well known.

FIG. 14 shows a conventional muffler, wherein the muffler comprises two casing elements 1 and 2, and a T-shape connecting pipe 3. The casing element 1 is integrally constructed of a cup-shaped portion 1*a* and a pipe portion 1*b* extending through a bottom 1*c* of the cup-shaped portion 1*a*, and the casing element 2 is integrally constructed of a cup-shaped portion 2*a* and a pipe portion 2*b* extending through a bottom 2*c* of the cup-shaped portion 2*a*. The casing elements 1 and 2 are made from a synthetic resin, by monolithic molding.

The connecting pipe 3 comprises a communicating portion 3*a* and connecting portions 3*b* and 3*c*. The cup-shaped portions 1*a* and 2*a* are engaged with each other at the end portions 1*d* and 2*d*, and at the same time, the pipe portion 1*b* is fitted into the connecting portion 3*b* and the pipe portion 2*b* is fitted into the connecting portion 3*c*. The engaging portion 4 of the end portions 1*d* and 2*d* is welded.

The above construction defines a shielded resonance chamber 7, and the pipe portions 1*b* and 2*b* are communicated with the resonance chamber 7 through the communicating portion 3*a*.

In this kind of muffler, the noise frequency suppressed by the muffler is mainly determined by the volume of the resonance chamber 7 and the diameter and length of the communicating portion 3*a*.

In this conventional muffler, only one noise frequency can be suppressed, but recent developments have created a demand for the suppression of low frequency noise. Namely, in many cases, the suppression of only a single noise frequency is not sufficient to meet the requirements for a much lower level of noise.

SUMMARY OF THE INVENTION

An object of the present invention is to provide a resonance muffler capable of suppressing a plurality of noise frequencies, using a lighter weight muffler able to be easily assembled.

According to the present invention, there is provided a muffler for suppressing a plurality of noise frequencies comprising: a casing; means for defining at least two resonance chambers in the casing, each resonance chamber having a different resonance frequency; a pipe means for flowing a gas therethrough; and means for communicating the pipe means to each resonance chamber.

The present invention may be more fully understood from the description of the preferred embodiments of the invention set forth below, together with the accompanying drawings.

DESCRIPTION OF THE PREFERRED EMBODIMENTS

Figure 1:
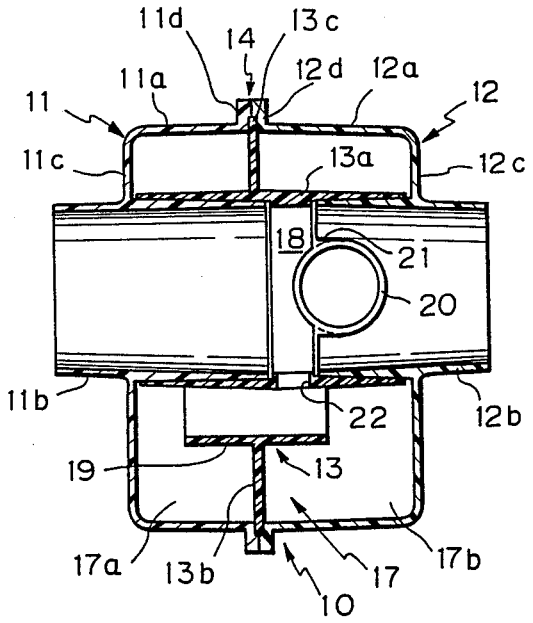
FIG. 1 is a longitudinal sectional view of the first embodiment of a muffler of the present invention.
Figure 2:
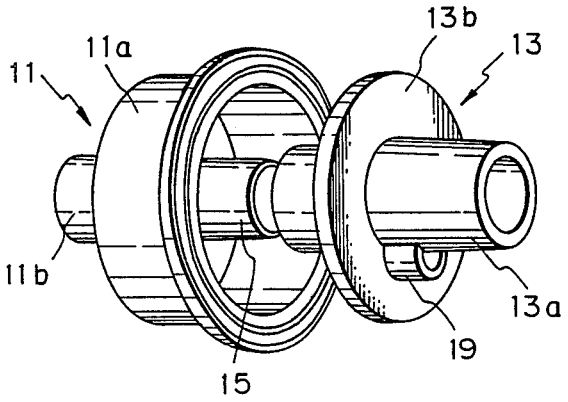
FIG. 2 is an exploded partially perspective view of the muffler shown in FIG. 1.
Figure 3:
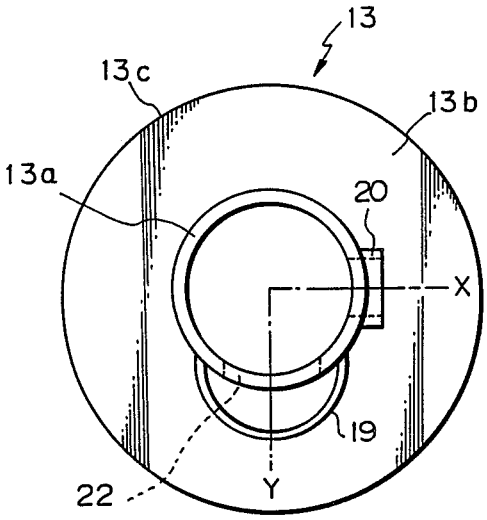
FIG. 3 is a right side view of a defining member shown in the FIG. 1.

The first embodiment of this invention is shown in FIG. 1, 2, and 3, wherein reference numeral 10 designates a muffler which comprises two casing elements 11 and 12 and a defining member 13. The casing element 11 comprises a cup-shaped portion 11*a* and a pipe portion 11*b* extending through a bottom portion 11*c* of the cup-shaped portion 11*a*, and the casing element 12 comprises a cup-shaped portion 12*a* and a pipe portion 12*b* extending through a bottom portion 12*c* of the cup-shaped portion 12*a*. These casing elements 11 and 12 are integrally molded from a synthetic resin. The pipe portion 11*b* is an inlet pipe and is connected at the left end thereof (as seen in FIG. 1) to an air cleaner (not shown) of an I.C.E. engine. The pipe portion 12*b* is an outlet pipe and is connected at the right end thereof (as seen in FIG. 1) to a carburetor (not shown) of an I.C.E. engine. In this system, air flows from the inlet pipe llb to the outlet pipe 12*b*.

The casing elements 11 and 12 are joined together at the open sides of the cup-shaped portions 11*a* and 12*a*, and are welded at the joint 14 by vibration welding. Note, vibration welding denotes a process whereby the casing elements made of a synthetic resin are subjected to microvibration to join these elements by welding caused by frictional heat generated between the two elements. When the casing elements 11 and 12 are joined in this way, a shield resonance chamber 17 is formed by the cup-shaped portions 11*a* and 12*a*.

A defining member 13 comprises a connecting pipe portion 13*a* and a flange portion 13*b* formed on an outer surface of the connecting pipe portion 13*a* and located to the left of the center of the connecting pipe portion 13*a*. The defining member 13 is integrally formed from an elastomer. A resonance tube 19 is integrally formed on the outer surface of the connecting pipe portion 13*a*, and extended through the flange portion 13*b* and along the axis of the connecting pipe portion 13*a*.

The right end of the inlet pipe 11*b* (as seen in the FIG. 1 is fitted in the left end of the connecting pipe portion 13*a*, and the left end of the outlet pipe 12*b* is fitted in the right end of the connecting pipe portion 13*a* (FIG. 1). Each end of the connecting pipe portion 13*a* is engaged with the inside surface of each of the bottom portions 11*c* and 12*c* of the cup-shaped portions 11*a* and 12*a*, and a passage 18 is defined between the right end of the inlet pipe 11*b* and the left end of the outlet pipe 12*b* (FIG. 1). The passage 18 is located at the right of the flange portion 13*b* (FIG. 1). The circumferential peripheral portion 13*c* of the flange portion 13*b* is sandwiched between the circumferential peripheral portion 11*d* of the open end of the cup-shaped portion 11*a* and the circumferential peripheral portion 12*d* of the open end of the cup-shaped portion 12*a*, and thus the resonance chamber 17 is divided into a first chamber 17*a* and a second chamber 17*b* by the flange portion 13*b*. A communicating hole 22 is formed in the wall of the connecting pipe 13*a*, to communicate the resonance tube 19 with the passage 18.

A second resonance tube 20 is integrally formed on the outer surface of the connecting pipe portion 13*a*, at the right side with respect to the flange portion 13*b* (FIG. 1), and extended radially along the connecting pipe portion 13*a*. The axis X of the second resonance tube 20, and the line Y passing the center point of the connecting pipe portion 13*a* and the center point of the first resonance tube 19 are at right angles to each other (FIG. 3). A port 21 is formed at the left end of the outlet pipe 12*b* to communicate the second resonance tube 20 with the outlet pipe 12*b*. Therefore, the passage 18 is communicated with the first and second resonance chambers 17*a*, 17*b* through the communicating hole 22 and the first resonance tube 19, and with the second resonance chamber 17*b* through the port 21 and the second resonance tube 20.

The process of assembling the muffler according to the present invention is now described.

The casing elements 11 and 12 are integrally molded from a synthetic resin, and the defining member 13 is made from an elastomer. The inlet pipe 11*b* and the outlet pipe 12*b* are fitted in each side of the connecting pipe portion 13*a*, and at the same time, the circumferential peripheral portion 13*c* of the flange portion 13*b* is sandwiched between the circumferential peripheral portion 11*d* of the open end of the cup-shaped portion 11*a* and the circumferential peripheral portion 12*d* of the open end of the cup-shaped portion 12*a*. The joint 14 is then welded by vibration welding, and thus the assembly of the muffler is completed. Accordingly, it can be seen that this muffler is very easily produced, and further, has a light weight.

Figure 4:
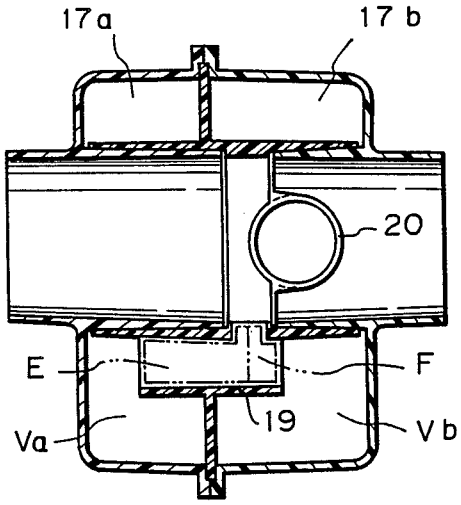
FIG. 4 is an explanatory view of the operation of the muffler in FIG. 1.

The operation of the muffler according to the present invention will be now described. Because the passage 18 is communicated with the first resonance chamber 17*a* through the first resonance tube 19, noise is propagated from the passage 18 to the first resonance chamber 17*a* via the first resonance tube 19. In this case, the resonance passage is shown as the area E in FIG. 4, and a resonance frequency of the first resonance chamber 17*a* having a resonance volume Va is designated as f1.

Further, because the first resonance tube 19 is communicated with the second resonance chamber 17*b*, noise is propagated from the passage 18 to the second resonance chamber 17*b* via the first resonance tube 19. In this case, the resonance passage is shown as the area F in FIG. 4, and the resonance frequency of the second resonance chamber 17*b* having a resonance volume Vb, is designated as f2.

Furthermore, because the passage 18 is communicated with the second resonance chamber 17*b* through the second resonance tube 20, noise is propagated from the passage 18 to the second resonance chamber 17*b* via the second resonance tube 20. In this case, the resonance frequency of the second resonance chamber 17*b* having a resonance volume Vb, is designated as f3.

The noise frequencies FA, FB which can be suppressed by this muffler are calculated by the following equation.

$$FA = f1$$

$$FB = f2^2 + f3^2$$

Note: It is well known that, in general, when a sectional area of a resonance tube is increased, the noise suppression effect is increased. But, if the sectional area of the resonance tube is increased, the length of the resonance tube must be elongated to suppress a specific noise frequency. In this embodiment, since the first resonance tube 19 extends through the flange portion 13*b* and along the axis of the connecting pipe portion 13*a*, even if the first resonance tube 19 is elongated, the size of the muffler 10 as a whole is not increased, and thus a compact muffler can be realized.

Figure 5:
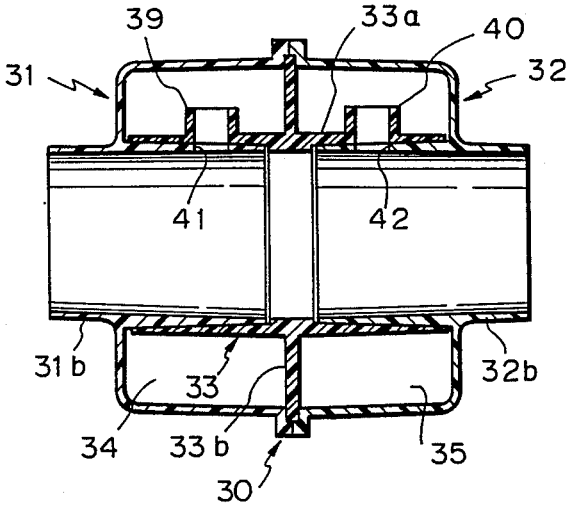
FIG. 5 is a longitudinal sectional view of the second embodiment of the muffler of the present invention.

The second embodiment of this invention is shown in FIG. 5, wherein 30 designates a muffler which comprises casing elements 31, 32 and a defining member 33. Resonance tubes 39 and 40 are formed on an outer surface of the connecting pipe portion 33*a*, on opposite sides of the flange portion 33*b*, and extend in the same direction along the radius of the connecting pipe portion 33*a*. A communicating hole 41 is formed in the inlet pipe portion 31*b* to communicate the resonance chamber 34 with the inlet pipe portion 31*b* through the resonance tube 39, and a communicating hole 42 is formed in the outlet pipe portion 32*b* to communicate the resonance chamber 35 with the outlet pipe portion 32*b* through the resonance tube 40. The construction of the other parts of the muffler is the same as that of the muffler of the first embodiment, and therefore, a description thereof is omitted. In this embodiment, the muffler is constructed substantially by integrating two mufflers. As in the first embodiment, the muffler can be easily produced and has a lighter weight, and further, two noise frequencies can be suppressed at the same time.

Figure 6:
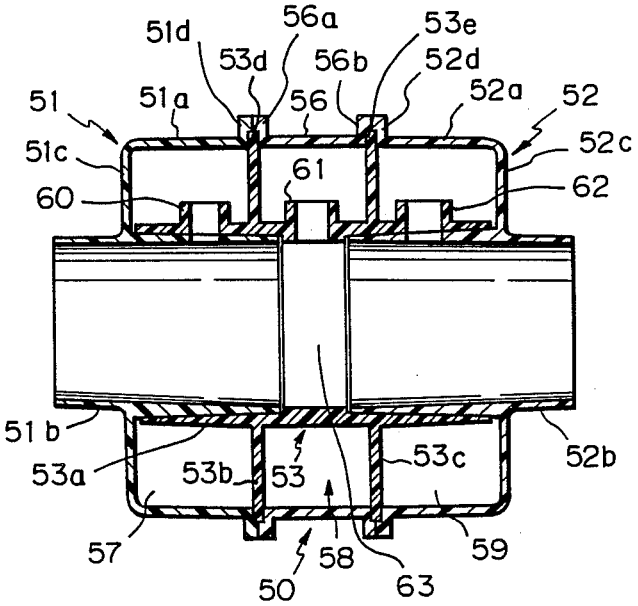
FIG. 6 is a longitudinal sectional view of the third embodiment of a muffler of the present invention.

The third embodiment of this invention is shown in FIG. 6, wherein 50 designates a muffler which comprises casing elements 51 and 52, a cylindrical portion 56 open at the top and bottom thereof, and a defining member 53.

The defining member 53 comprises a connecting pipe portion 53*a* and two flange portions 53*b* and 53*c* formed integrally on the outer surface of the connecting pipe portion 53*a* at a suitable spacing therebetween.

In this embodiment, first, second, and third resonance tubes 60, 61, and 62 are integrally formed on the connecting pipe portion 53*a*, and extended in the same direction along the radius of the connecting pipe portion 53*a*. The first resonance tube 60 is located between the first flange portion 53*b* and the bottom portion 51*c* of the cup-shaped portion 51*a*; the second resonance tube 61 is located between the first and second flange portions 53*b* and 53*c*; and the third resonance tube 62 is located between the second flange portion 53c and the bottom portion 52c of the cup-shaped portion 52a.

The right end of the inlet pipe 51b is fitted in the left end of the connecting pipe portion 53a, and thus a circumferential peripheral portion 53d of the first flange portion 53b is sandwiched between the circumferential peripheral portion 51d of the open end of the cup-shaped portion 51a and the circumferential peripheral portion 56a of the left end of the cylindrical portion 56. The circumferential peripheral portions 51d and 56a are welded together by vibration welding, and therefore, a sealing effect among the circumferential peripheral portions 51d, 53d and 56a is obtained.

The left end of the outlet pipe 52b is fitted in the right end of the connecting pipe portion 53a, and thus a circumferential peripheral portion 53e of the second flange portion 53c is sandwiched between the circumferential peripheral portion 56b of the right end of the cylindrical portion 56 and the circumferential peripheral portion 52d of the open end of the cup-shaped portion 52a. The circumferential peripheral portions 56b and 52d are then welded together by vibration welding, and therefore, a sealing effect among the circumferential peripheral portions 56b, 53e, and 52d is obtained. A first resonance chamber is defined by the cup-shaped portion 51a, the connecting pipe portion 53a, and the first flange portion 53b, a second resonance chamber is defined by the first and second flange portions 53b and 53c, the connecting pipe portion 53a, and the cylindrical portion 56, and a third resonance chamber is defined by the cup-shaped portion 52a, the connecting pipe portion 53a, and the second flange portion 53c. The first resonance tube 60 communicates the inlet pipe 51b with the first resonance chamber 57, the second resonance tube 61 communicates the passage 63 of the inlet and outlet pipe 51b and 52b with the second chamber 58, and the third resonance tube 62 communicates the outlet pipe 52b with the third resonance chamber 59. This muffler is constructed substantially by integrating three mufflers, and as in the above embodiments, the muffler is very easily produced and assembled and has a lighter weight, and further, three noise frequencies can be suppressed thereby at the same time.

In this embodiment, if a plurality of the cylindrical portions are connected between the casing elements 51 and 52, and a plurality of the resonance chambers are defined by a plurality of the flange portions, more than four noise frequencies can be suppressed.

Figure 7:
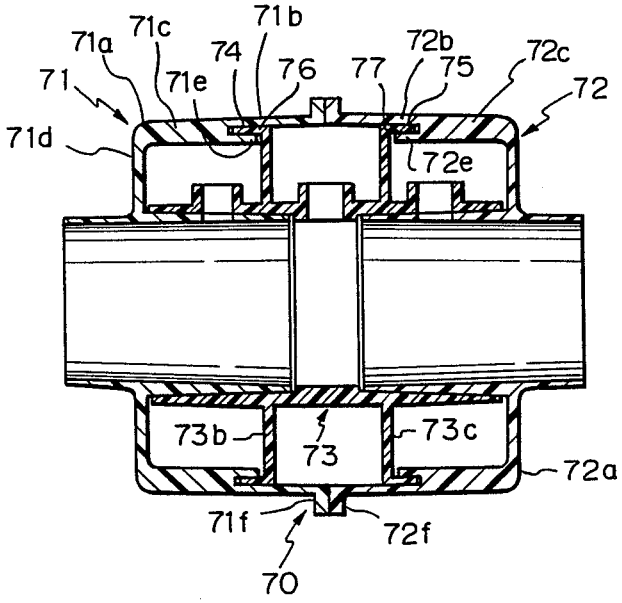
FIG. 7 is a longitudinal sectional view of the fourth embodiment of a muffler of the present invention.

The fourth embodiment of this invention is shown in FIG. 7, wherein 70 designates a muffler which comprises casing elements 71 and 72, and a defining member 73. A part of a cylindrical portion 71b is thickened and the thickened portion 71c is extended from a bottom portion 71d. A circumferential step portion 71e is formed on the inner surface of the cylindrical portion 71b at the terminating point of the thickened portion 71c, and a circumferential groove 74 is formed at the circumferential step portion 71e and extended along the axis of the cup-shaped portion 71a. Similarly a thickened portion 72c and a circumferential step portion 72e are formed on the inner surface of the cylindrical portion 72b, and a circumferential groove 75 is formed at the circumferential step portion 72e. An L-shaped engaging portion 76 is formed along the whole circumferential periphery of the first flange portion 73b. Note, it is possible to form the engaging portion 76 at a part of the circumferential periphery of the first flange portion 73b. Similarly, an L-shaped engaging portion 77 is formed along the whole circumferential periphery of the second flange portion 73c. Each of the engaging portions 76 and 77 is extended in an opposite direction along the axis of the cup-shaped portions 71a and 72a, and each of the engaging portions 76 and 75 is respectively fitted in each of the grooves 74 and 75.

The circumferential peripheral portions 71f and 72f of the cup-shaped portions 71a and 72a are joined together and welded by vibration welding.

The effect obtained by the second and third embodiments also can be obtained by this embodiment, and in addition, in this embodiment, the flange portion will not move from the desired position during welding, and therefore, the desired resonance frequencies of the resonance chambers are obtained, and thus the desired noise frequencies can be suppressed.

Figure 8:
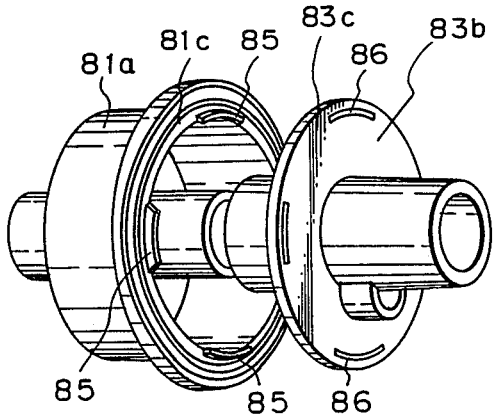
FIG. 8 is a exploded partially perspective view of the fifth embodiment of a muffler of the present invention.
Figure 9:
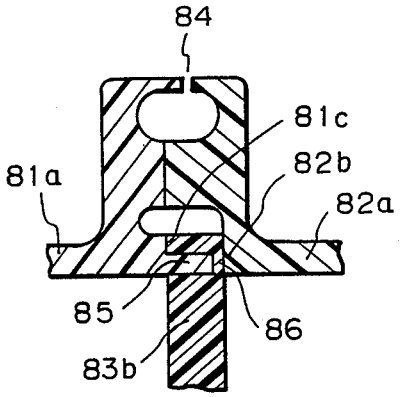
FIG. 9 is a enlarged partially longitudinal sectional view of the muffler shown in FIG. 8.

The fifth embodiment of this invention is shown in FIGS. 8 and 9. FIGS. 8 and 9 show four projections 85 projected onto the circumferential end surface 81c of the cup-shaped portion 81a. The end surface 81c is engaged with the circumferential peripheral portion 83c of the flange portions 83b in the circumferential direction. The four projections 85 all have the same length and are spaced at the same distances along the circumferential direction thereof. Four holes 86 are formed in the circumferential peripheral portion 83c to correspond to the four projections 85, and when the projections 85 are fitted in the holes 86, respectively, the circumferential peripheral portion 83c of the flange portion 83b is sandwiched between the end surface 81c of the cup-shaped portion 81a and the circumferential end surface 82b of the cup-shaped portion 82a, and the joint portion 84 of the cup-shaped portions 81a and 82a is then welded by vibration welding.

Therefore, when welding the joint portion 84, the flange portion 83b will not move from the desired position, and thus a gas leakage from the circumferential end surfaces 81c, 82b and the circumferential peripheral portion 81c is completely prevented.

Figure 10:
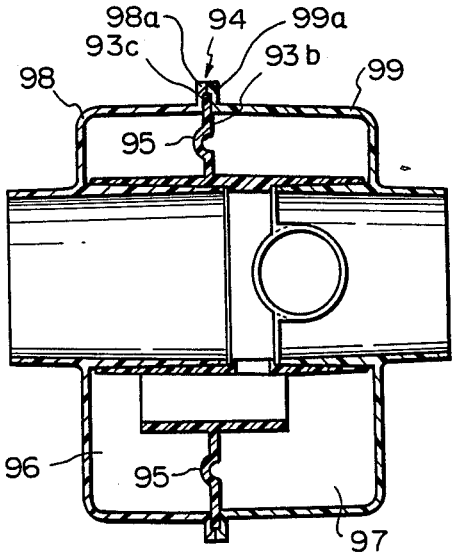
FIG. 10 is a longitudinal sectional view of the sixth embodiment of a muffler of the present invention.

The sixth embodiment of this invention is shown in FIG. 10. FIG. 10 shows a circumferentially convex absorbing portion 95 formed on the surface of the flange portion 93b. The absorbing portion 95 is formed as a semi-circle, and a thickness of the absorbing portion 95 is the same as the thickness of the flange portion 93b.

In this embodiment, the absorbing portion 95 absorbs the displacement of the flange portion 93b, produced by an external force when welding, and accordingly, the circumferential peripheral portion 93c is maintained in a firm and correct fit with the circumferential peripheral portions 98a and 99b of the cup-shaped portion 98 and 99, and thus the two resonance chambers 96 and 97 are divided without air leakage from the flange portion 93b.

Note, it is possible that the thickness of the absorbing portion 95 can be made thinner than the thickness of the flange portion 93b, or the absorbing portion 95 can be formed as a bellows. Namely, the configuration of the absorbing portion 95 may be any configuration which can absorb the displacement of the flange portion 93b produced by a external force when welding, to ensure that the circumferential peripheral portion 93c is not displaced from the joint 94 and is firmly and correctly sandwiched at the joint 94.

The effect obtained by this embodiment is as same as that of the fifth embodiment.

Figure 11:
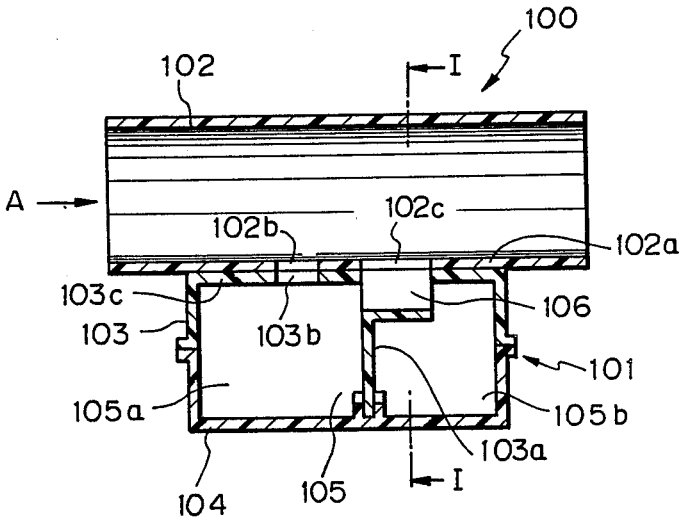
FIG. 11 is a longitudinal sectional view of the seventh embodiment of a muffler of the present invention.
Figure 12:
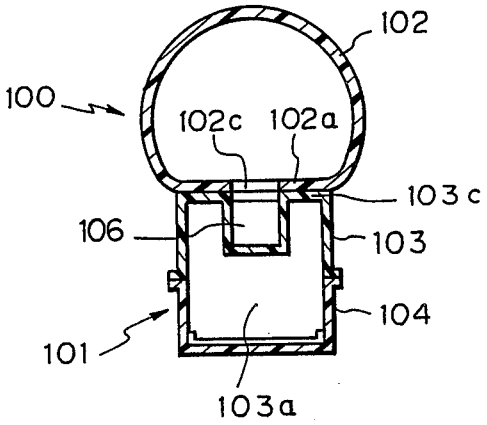
FIG. 12 is a cross-sectional view taken along the line I—I of FIG. 11.
Figure 13:
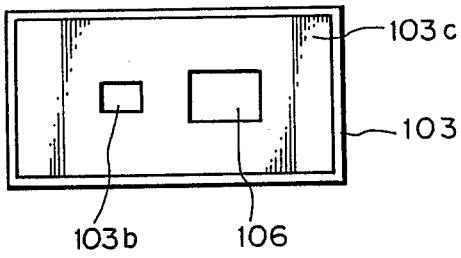
FIG. 13 is a plan view of the resonance portion shown in FIG. 11.
Figure 14:
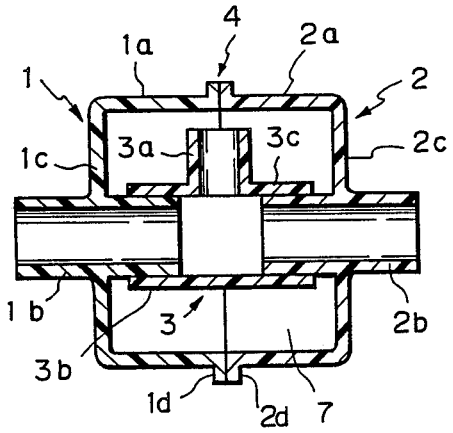
Fig. 14 PRIOR ART
FIG. 14 is a longitudinal sectional view of a conventional muffler.

The seventh embodiment of this invention is shown in FIGS. 11, 12, and 13. In FIGS. 11, 12, and 13, reference numeral 100 designates a muffler 5 which comprises a resonance portion 101 and a pipe portion 102. The pipe portion 102 has a cylindrical configuration and is provided with a flat portion 102*a*. The flat portion 102*a* is extended along the axis of the pipe portion 102, and two rectangular holes 102*b* and 102*c* are formed in the flat portion 102*a*. Air flows in the pipe portion 102 in the direction shown by the arrow A. The resonance portion 101 has a box configuration and comprises an upper element 103 and a lower element 104. A dividing wall 103*a* is formed on the upper element 103 to divide the resonance chamber 105 into a first chamber 105*a* and a second chamber 105*b*. A communicating hole 103*b* corresponding to the hole 102*b* is formed in the upper wall 103*c* of the upper element 103, and therefore, the pipe portion 102 is communicated with the first resonance chamber 105*a* through the communicating holes 102*b* and 103*b*. A resonance passage 106 is formed along the upper wall 103*c* and extended through the defining wall 103*a*, and thus the first resonance chamber 105*a* is communicated with the second resonance chamber 105*b* through the resonance passage 106. Further, the upper portion of the resonance passage 106 has an opening corresponding to the hole 102*c*, and therefore, the pipe portion 102 is communicated with the first and second resonance chambers 105*a* and 105*b* through the hole 102 and the resonance passage 106.

The volume of the first resonance chamber 105*a* is greater than the volume of the second resonance chamber 105*b*, and the resonance passage 106 is extended into the second chamber 105*b* and terminated at the defining wall 103*a*. The sectional area of the hole 102*c* is larger than the sectional area of the hole 102*b*.

While the invention has been described by reference to specific embodiments chosen for purposes of illustration, it should be apparent that numerous modifications could be made thereto by those skilled in the art without departing from the basic concept and scope of the invention.

We claim:

1. A muffler, comprising:

a pipe having a tubular wall;

a casing attached to an outer face of said tubular wall, and said casing covering a predetermined region of said outer face of said tubular wall to define a resonance chamber therein;

a wall member in contact with said outer face of said tubular wall and extending essentially over the entire region of said outer face of said tubular wall;

at least one separating wall connected to said wall member at one end thereof an connected to an inner wall of said casing, which faces said wall member, at another end thereof, to divide said resonance chamber into at least two resonance chamber portions; and communicating means for communicating an interior of said pipe with said resonance chamber portions, said communicating means having at least one opening means extending through both said tubular wall and said wall member.

2. A muffler according to claim 1, wherein:

said pipe comprises a first pipe portion and a second pipe portion aligned with said first pipe portion;

said casing comprises a first casing portion integrally formed with said first pipe portion, from a synthetic resin material, and a second casing portion integrally formed with said second pipe portion, from a synthetic resin material, and connected to said first casing portion; and said wall member circumferentially extends along outer faces of both said first pipe portion and said second pipe portion.

3. A muffler according to claim 2, wherein said separating wall is a single wall arranged so as to divide said resonance chamber into said two resonance chamber portions and said separating wall is formed integrally with said wall member.

4. A muffler according to claim 3, wherein said separating wall has a peripheral portion sandwiched between said first casing portion and said second casing portion.

5. A muffler according to claim 2, wherein said communicating means have another opening means extending through said separating wall and communicating said two resonance chamber portions with each other.

6. A muffler according to claim 2, in which:

said communicating means includes a first hole and a second hole extending through said tubular wall and said wall member; and said first hole communicates one of said resonance chamber portions with the interior of said pipe, and said second hole communicates the other of said resonance chamber portions with the interior of said pipe.

7. A muffler according to claim 1, including an absorbing portion formed on said separating wall for absorbing a displacement of said separating wall due to an external force.

8. A muffler according to claim 2, wherein a peripheral portion of said separating wall has at least one groove; and including at least one projection engagable with said groove formed on one of said first portion and second casing portion to connect said separating wall to said casing by fitting said projection into said groove.

9. A muffler according to claim 2, wherein an inner end of said first pipe portion is spaced from an inner end of said second pipe portion to form a gap therebetween, and said wall member entirely covers said gap.

10. A muffler according to claim 2, including connection means formed by vibration welding connecting peripheral portions of said first casing and second casing portion.

11. A muffler according to claim 2, wherein:

said separating wall comprises two walls arranged so as to divide said resonance chamber into a first resonance chamber portion, a second resonance chamber portion, and a third resonance chamber portion;

said two wall being formed integrally with said wall member;

an L-shaped engaging portion is formed at the peripheral portion of each of said two walls of said separating wall; and a groove corresponding to said engaging portion is formed at an inner surface of each said first and second casing portion, each of said two walls of said separating wall being fixed to said casing by fitting said engaging portion into said groove.

12. A muffler according to claim 1, wherein:

said pipe comprises a first pipe portion and a second pipe portion aligned with said first pipe portion;

said casing comprises a first casing portion integrally formed with said first pipe portion, from a synthetic resin material, a second casing portion integrally formed with said second pipe portion, from a synthetic resin material, and a third casing portion formed by a synthetic resin and arranged between said first casing portion and said second casing portion;

said wall member circumferentially extending along outer faces of both said first pipe portion and said second pipe portion; and said separating wall comprises two walls arranged so as to divide said resonance chamber into a first resonance chamber portion, a second resonance chamber portion, and a third resonance chamber portion which is located between said first and said second resonance chamber portions, and said two walls being formed integrally with said wall member.

13. A muffler according to claim 12, wherein:

said first, second and third casing portions are joined to each other; and one of said two walls of said separating wall has a peripheral portion sandwiched between said second casing portion and said third casing portion.

14. A muffler according to claim 12, in which:

said communicating means comprises a first hole and a second hole extending through said tubular wall and said wall member;

a gap is formed between an inner end of said first pipe portion and an inner end of said second pipe portion, and said wall member entirely covers said gap;

said first hole communicating said first resonance chamber portion with the interior of said pipe, said second hole communicating said second resonance chamber portion with the interior of said pipe; and said communicating means further comprising another hole extending through said tubular wall to communicate said third resonance chamber portion with said gap.

15. A muffler according to claim 1, wherein said casing is integrally formed with said wall member, from a synthetic resin.

16. A muffler according to claim 1, wherein:

said separating wall is a single wall arranged so as to divide said resonance chamber into a first resonance chamber portion and a second resonance chamber portion, said first resonance chamber portion being communicated with the interior of said pipe by a hole, and said communicating means comprises another hole extending through said separating wall to communicate said first resonance chamber portion with said second resonance chamber portion.

17. A muffler according to claim 1, wherein:

said separating wall is a single wall arranged so as to divide said resonance into a first resonance chamber portion and a second resonance chamber portion, said first resonance chamber portion being communicated with the interior of said pipe by a hole; and said communicating means comprises another hole interconnecting said first resonance chamber portion, said second resonance chamber portion, and the interior of said pipe.

18. A muffler according to claim 1, wherein said casing comprises a first casing portion formed integrally with said wall member, and a second casing portion connected to said first casing portion and forming said inner wall facing said wall member, said separating wall being formed integrally with said first casing portion.

19. A muffler according to claim 1, wherein said wall member is made of an elastomer.

20. A muffler according to claim 1, wherein said at least one opening means has a fixed length defined by the thickness of said tubular wall and said wall member.

* * * * *